US011297989B2

(12) United States Patent
Park et al.

(10) Patent No.: US 11,297,989 B2
(45) Date of Patent: Apr. 12, 2022

(54) CLEANER

(71) Applicant: SAMSUNG ELECTRONICS CO., LTD., Suwon-si (KR)

(72) Inventors: Tae Sang Park, Suwon-si (KR); Hyeon Joon Oh, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 507 days.

(21) Appl. No.: 16/329,036

(22) PCT Filed: Aug. 2, 2017

(86) PCT No.: PCT/KR2017/008342
§ 371 (c)(1),
(2) Date: Feb. 27, 2019

(87) PCT Pub. No.: WO2018/043931
PCT Pub. Date: Mar. 8, 2018

(65) Prior Publication Data

US 2019/0216281 A1 Jul. 18, 2019

(30) Foreign Application Priority Data

Sep. 1, 2016 (KR) ..... 10-2016-0112631

(51) Int. Cl.
*A47L 9/16* (2006.01)
*A47L 9/22* (2006.01)
*A47L 9/28* (2006.01)

(52) U.S. Cl.
CPC ..... *A47L 9/16* (2013.01); *A47L 9/22* (2013.01); *A47L 9/2836* (2013.01); *A47L 9/2805* (2013.01); *A47L 2201/00* (2013.01)

(58) Field of Classification Search
CPC .. A47L 2201/00; A47L 2201/022; A47L 5/22; A47L 9/1409; A47L 9/16;
(Continued)

(56) References Cited

U.S. PATENT DOCUMENTS 5,342,171 A * 8/1994 Stanko ..... F04D 29/162 415/228
2010/0189557 A1 7/2010 Broom
(Continued)

FOREIGN PATENT DOCUMENTS

EP 2090788 A1 * 8/2009 ..... F04D 29/30
JP 08-193595 7/1996
(Continued)

OTHER PUBLICATIONS

WO 2015099155 A1—English Machine Translation (Year: 2015).*
(Continued)

*Primary Examiner* — Marc Carlson
(74) *Attorney, Agent, or Firm* — Staas & Halsey LLP

(57) ABSTRACT

Disclosed herein is a cleaner having an improved structure configured to improve the cleaning performance. The cleaner comprises a suction unit provided inside a body. The suction unit includes an impeller configured to suction air by rotating about a shaft, and a diffuser configured to guide air discharged from the impeller. The impeller includes a hub, and a blade disposed on the hub, and provided with a leading edge disposed in an upstream side in a direction in which air introduced into the suction unit flows, and a trailing edge disposed in a downstream side in the direction in which the air introduced into the suction unit flows. The leading edge of the blade forms an inclination of 60 degrees or more and 80 degrees or less with respect to an axial direction.

14 Claims, 14 Drawing Sheets

(58) Field of Classification Search
CPC ..... A47L 9/22; A47L 9/2805; A47L 9/2836; A47L 9/2884; F04D 17/168; F04D 29/284; F04D 29/30
See application file for complete search history.

(56) References Cited

U.S. PATENT DOCUMENTS

| | | | | |
|---|---|---|---|---|
| 2013/0236303 | A1* | 9/2013 | Teramoto | F04D 17/08 415/206 |
| 2016/0037984 | A1* | 2/2016 | Park | F04D 25/08 15/326 |
| 2017/0126076 | A1* | 5/2017 | Yoon | F04D 25/0606 |

FOREIGN PATENT DOCUMENTS

| | | | | |
|---|---|---|---|---|
| JP | 2009-293547 | | 12/2009 | |
| KR | 1998-060555 | | 11/1998 | |
| KR | 10-0748966 | | 8/2007 | |
| KR | WO2011/102120 | | 8/2011 | |
| KR | 10-2015-0118858 | | 10/2015 | |
| KR | 10-2016-0019140 | | 2/2016 | |
| KR | 20160019140 | A * | 2/2016 | A47L 5/22 |
| WO | WO-2012063375 | A1 * | 5/2012 | F04D 29/624 |
| WO | WO-2013058284 | A1 * | 4/2013 | F04D 29/624 |
| WO | WO-2015076102 | A1 * | 5/2015 | F02B 39/00 |
| WO | WO-2015099155 | A1 * | 7/2015 | F04D 29/08 |
| WO | WO-2016075955 | A1 * | 5/2016 | F04D 29/30 |
| WO | WO-2016194254 | A1 * | 12/2016 | F04D 29/44 |

OTHER PUBLICATIONS

Korean Office Action dated Sep. 27, 2019 in corresponding Korean Patent Application No. 10-2016-0112631.
International Search Report dated Nov. 24, 2017 in International Patent Application No. PCT/KR2017/008342.
Written Opinion of the International Searching Authority dated Nov. 24, 2017 in International Patent Application No. PCT/KR2017/008342.
Korean Office Action dated Mar. 21, 2019 from Korean Patent Application No. 10-2016-0112631, 14 pages.

* cited by examiner

CLEANER

CROSS-REFERENCE TO RELATED APPLICATIONS

This application is a U.S. National Stage Application which claims the benefit under 35 U.S.C. § 371 of International Patent Application No. PCT/KR2017/008342 filed on Aug. 2, 2017, which claims foreign priority benefit under 35 U.S.C. § 119 of Korean Patent Application No. 10-2016-0112631 filed on Sep. 1, 2016 in the Korean Intellectual Property Office, the contents of both of which are incorporated herein by reference.

TECHNICAL FIELD

The present disclosure relates to a cleaner, more particularly, to a cleaner having an improved structure configured to improve the cleaning performance.

BACKGROUND ART

Generally, a cleaner sucks air containing dirt from the surface to be cleaned, filters out and collects the dirt from the air, and then discharges the purified air to the outside.

The cleaner may include an impeller and a diffuser that is a component for determining the suction power.

The air sucked into a body flows along several bent flow paths to the impeller and diffuser in order. In this process, the pressure loss of the air is increased, and thus the impeller and the diffuser are designed to have a small distance therebetween so as to compensate for the reduction in the suction power. As the distance between the impeller and the diffuser is smaller, the noise caused by the pressure perturbation may occur. In order to avoid the noise, it is possible to increase the size of the impeller and the size of motor coupled to the impeller, but the size of the cleaner may be also increased. Therefore, it does not address recent market trends that require compact products.

Particularly, since a compact cleaner, such as a handy cleaner and a robot cleaner cannot employ a conventional high-power suction motor, the reduction in the suction efficiency caused by the pressure loss or the flow loss may be great.

DISCLOSURE

Technical Problem

The present disclosure is directed to providing a cleaner having an improved structure configured to improve the cleaning performance.

Further, the present disclosure is directed to providing a cleaner having an improved structure configured to prevent a noise.

Further, the present disclosure is directed to providing a cleaner having an improved structure configured to allow the cleaner to be downsized or compact.

Further, the present disclosure is directed to providing a cleaner having an improved structure configured to reduce a manufacturing cost.

Technical Solution

One aspect of the present disclosure provides a cleaner including a suction unit provided inside a body. The suction unit includes an impeller configured to suction air by rotating about a shaft, and a diffuser configured to guide air discharged from the impeller. The impeller includes a hub, and a blade disposed on the hub and provided with a leading edge disposed in an upstream side in a direction in which air introduced into the suction unit flows, and a trailing edge disposed in a downstream side in the direction in which the air introduced into the suction unit flows. The leading edge of the blade forms an inclination of 60 degrees or more and 80 degrees or less with respect to an axial direction.

The diffuser may include an inner casing, an outer casing arranged along an outer circumference of the inner casing to be spaced apart from the inner casing, and a vane disposed between the inner casing and the outer casing to form a flow path in which air discharged from the impeller flows.

The vane may have an airfoil shaped cross-section in the axial direction.

One end of the vane disposed in an upstream side of the flow path may be disposed at a lower position in the axial direction than at least one of an upper end of the inner casing and an upper end of the outer casing disposed in the upstream side of the flow path.

The trailing edge may include a first end coupled to the hub, and a second end disposed on the opposite side of the first end, and a distance (R1) between the shaft and the first end may be less than a distance (R2) between the shaft and the second end.

The inner casing may include an outer circumferential surface facing the outer casing, and a distance (R3) between the shaft and the outer circumferential surface of the inner casing may be greater than the distance R2 between the shaft and the second end.

The suction unit may further include a driving source connected to the shaft to provide a driving force to allow the impeller to rotate, and the driving source may include a permanent magnet direct current (PMDC) motor.

The diffuser may include a first diffuser on which the impeller is seated, and a second diffuser coupled to the first diffuser in the axial direction.

The suction unit may further include a cover provided with an air inlet, and coupled to the second diffuser to accommodate the impeller and the first diffuser therein.

Another aspect of the present disclosure provides a cleaner including a suction unit provided inside a body. The suction unit includes an impeller configured to suction air by rotating about a shaft, and a diffuser configured to guide air discharged from the impeller. The impeller includes a hub, and a blade disposed on the hub and provided with a trailing edge disposed in a downstream side in a direction in which air introduced into the suction unit flows, the trailing edge having a first end coupled to the hub and a second end disposed on the opposite side of the first end. A distance (R1) between the shaft and the first end is less than a distance (R2) between the shaft and the second end.

The diffuser may include an inner casing, an outer casing arranged along an outer circumference of the inner casing to be spaced apart from the inner casing, and a vane disposed between the inner casing and the outer casing to form a flow path in which air discharged from the impeller flows.

The inner casing may include an outer circumferential surface facing the outer casing, and a distance (R3) between the shaft and the outer circumferential surface of the inner casing may be greater than the distance R2 between the shaft and the second end.

The vane may have an airfoil shaped cross-section in an axial direction.

The leading edge of the blade may form an inclination of 60 degrees or more and 80 degrees or less with respect to the axial direction.

The suction unit may further include a driving source connected to the shaft to provide a driving force to allow the impeller to rotate, and the driving source may include a permanent magnet direct current (PMDC) motor.

Another aspect of the present disclosure provides a cleaner including a suction unit provided inside a body. The suction unit includes an impeller configured to suction air by rotating about a shaft, the impeller provided with a hub having a central portion and an edge portion disposed in a lower than the central portion, and a plurality of blades disposed on the hub to be spaced apart from each other, a diffuser configured to guide air discharged from the impeller, and a permanent magnet direct current (PMDC) motor connected to the shaft to provide a driving force to allow the impeller to rotate.

Each of the plurality of blades may include a leading edge disposed in an upstream side in a direction in which air introduced into the suction unit flows, and a trailing edge disposed in a downstream side in the direction in which the air introduced into the suction unit flows, and the leading edge of the blade may form an inclination of 60 degrees or more and 80 degrees or less with respect to an axial direction.

The diffuser may include an inner casing, an outer casing arranged along an outer circumference of the inner casing to be spaced apart from the inner casing, and a vane disposed between the inner casing and the outer casing to form a flow path in which air discharged from the impeller flows and formed to have an airfoil shaped cross-section in an axial direction.

Advantageous Effects

It is possible to increase the suction efficiency of a cleaner by designing a leading edge of a blade to have an inclination of 60 degrees or more and 80 degrees or less with respect to an axial direction X.

A suction unit is designed such that a distance R1 between a shaft and a first end of a trailing edge, a distance R2 between the shaft and a second end of the trailing edge, and a distance R3 between the shaft and an outer circumferential surface of an inner casing of a diffuser satisfies a relation of "R1<R2<R3", and thus it is possible to increase the suction efficiency of a cleaner.

A vane of the diffuser is designed to have an airfoil shaped cross-section, and thus the increase of the suction efficiency and the reduction of the noise may be expected.

It is possible to implement a cleaner having a compact design by combining a semi-open impeller such as an impeller according to one embodiment, with a permanent magnet direct current (PMDC) motor, and the reduction in the manufacturing cost and the noise may be expected.

MODES FOR THE INVENTION

Hereinafter embodiments of the present disclosure will be described with reference to drawings. In the following detailed description, the terms of "front end", "rear end", "upper portion", "lower portion", "upper end", "lower end" and the like may be defined by the drawings, but the shape and the location of the component is not limited by the term.

A suction unit 100 according to one embodiment of the present disclosure may be applicable to various types of cleaners including a canister type in which a body and a suction nozzle are separated from each other and then connected by a certain pipe, an up-right type in which a body and a suction nozzle are designed as a single piece, a handy type and a robot cleaner. Hereinafter a case in which the suction unit 100 is applied to a robot cleaner will be mainly described.

Figure 1:
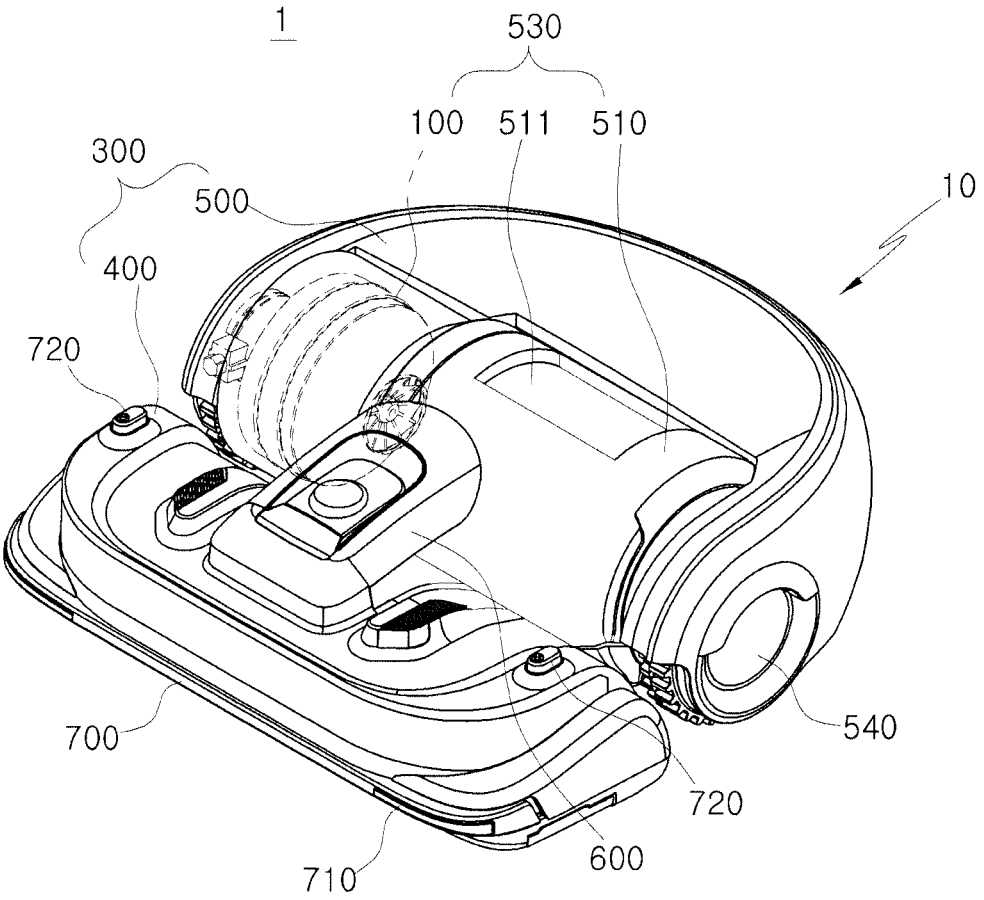
FIG. 1 is a perspective view showing an appearance of a cleaner according to one embodiment of the present disclosure.

FIG. 1 is a perspective view showing an appearance of a cleaner according to one embodiment of the present disclosure As shown in FIG. 1, a cleaner 1 may include a body forming an appearance, and housings 400 and 500 forming at least one portion of the appearance of the body.

The housings 400 and 500 may include a first housing 400 formed on the front side, and a second housing 500 formed on the rear side. A connecting member 600 configured to connect the first housing 400 to the second housing 500 may be disposed between the first housing 400 and the second housing 500.

The second housing 500 may be coupled to a dust collection unit 530 configured to store dust. The dust collection unit 530 may include a suction unit 100 providing power to suction dust and a dust collection container 510 storing the sucked dust.

The dust collection container 510 is provided with a grip portion 511 recessed to be held by a user. The user can grip the grip portion 511 and turn the dust collection container 510, thereby separating the dust collection container 510 from the second housing 500. The user can remove dust accumulated in the dust collection container 510 after separation. A drive unit configured to drive the body may be provided on lateral sides of the second housing 500. The drive unit may include a driving wheel 540 for driving of the body, and a rotatable roller (not shown) minimizing a driving load of the body. The driving wheel 540 may be coupled to opposite side surfaces of the second housing 500.

The first housing 400 may be provided with a brush unit (not shown) configured to sweep and collect dust on the floor. A bumper 700 configured to reduce a noise and impact, which is generated when the cleaner 1 collides with a wall during driving, may be coupled to the front side of the first housing 400. An additional buffer member 710 may be coupled to the bumper 700.

An entry blocking sensor 720 may be provided to be protruded on the upper surface of the first housing 400. The entry blocking sensor 720 may prevent the cleaner 1 from entering a certain section by detecting infrared rays. The entry blocking sensor 720 may be installed on opposite sides of the first housing 400.

Figure 2:
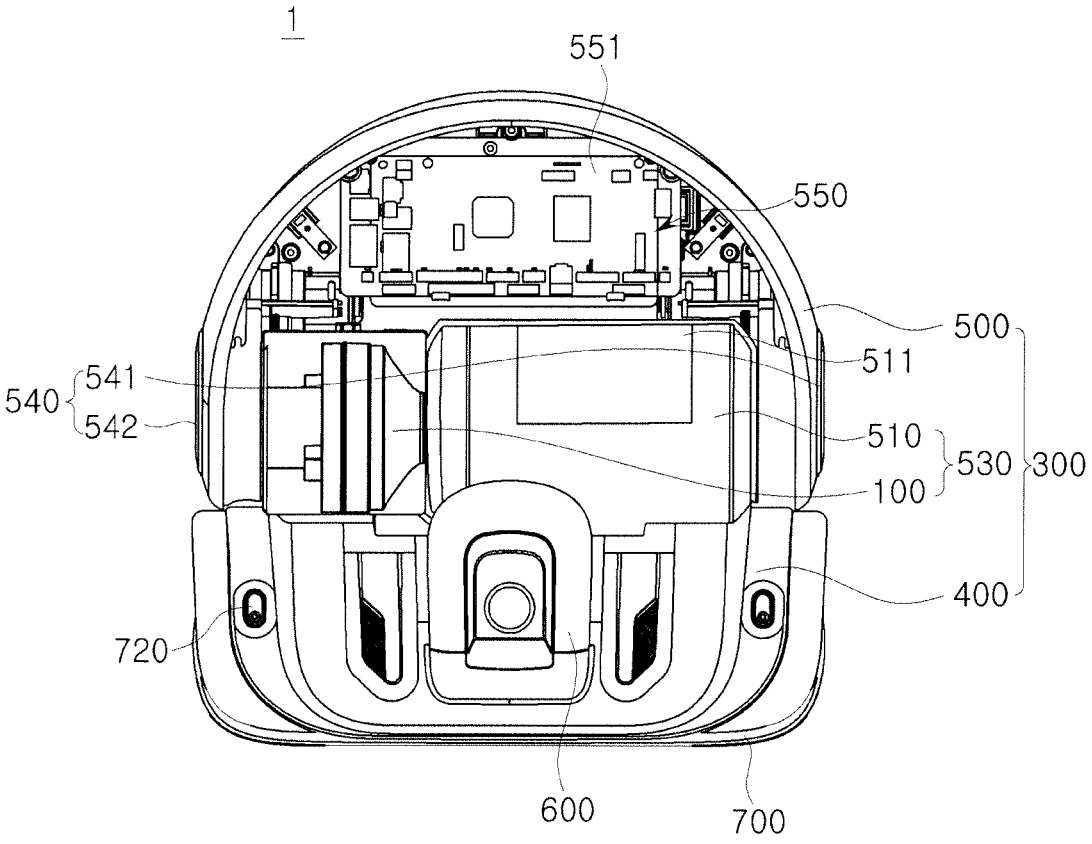
FIG. 2 is a plan view showing a state in which an outer housing of a second housing of the cleaner according to one embodiment of the present disclosure is removed.
Figure 3:
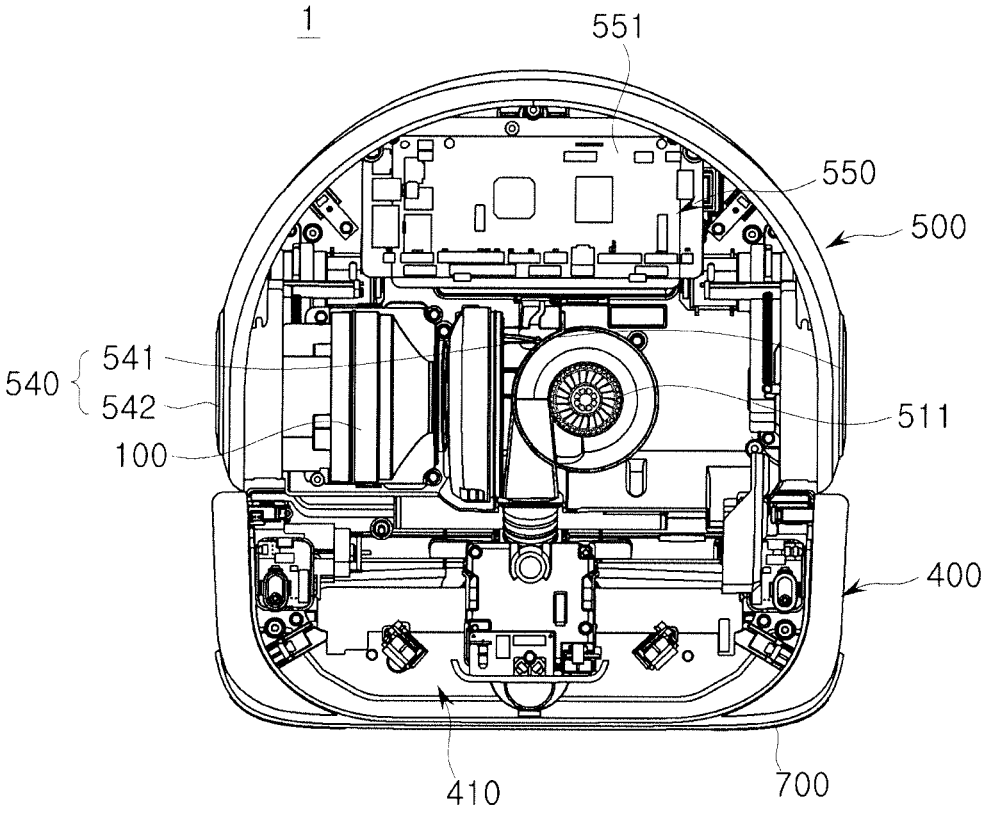
FIG. 3 is a plan view showing a state in which an outer housing of a first housing and the second housing, and a dust container of the cleaner according to one embodiment of the present disclosure is removed.

FIG. 2 is a plan view showing a state in which an outer housing of a second housing of the cleaner according to one embodiment of the present disclosure is removed, and FIG. 3 is a plan view showing a state in which an outer housing of a first housing and the second housing, and a dust container of the cleaner is removed according to one embodiment of the present disclosure.

As shown in FIGS. 2 and 3, a power supply unit 550 supplying power to drive the body may be coupled to the inner side of the second housing 500. The power supply unit 550 may include a battery (not shown), a main board 551 and a display (not shown) disposed above the main board 551 to display a state of the cleaner 1. The power supply unit 550 may be disposed behind the dust collection unit 530.

The battery (not shown) is provided with a rechargeable secondary battery. The battery (not shown) is charged by receiving the power from a docking station (not shown) when the cleaning process is completed and the body is coupled to the docking station (not shown).

When the dust collection container 510 is removed, a blowing fan (not shown) sucking dust and then moving the dust to the inside of the dust collection container 510 may be provided. Dust may be accumulated in the dust collection container 510 by the operation of the blowing fan and a user can easily remove the dust by separating the dust collection container 510.

The suction unit 100 may be disposed inside a suction unit housing (not shown). The suction unit 100 may be coupled to the lateral side of the dust collection container 510. According to one embodiment, the driving wheel 540 may be disposed on the lateral side of each of the dust collection container 510 and the suction unit 100. That is, the driving wheel 540 may include a first driving wheel 541 and a second driving wheel 542. The first driving wheel 541 may be disposed in the lateral side of the suction unit 100, and the second driving wheel 542 may be disposed in the lateral side of the dust collection container 510.

Accordingly, the dust collection container 510, the suction unit 100, and the driving wheel 540 may be disposed in the lateral direction of the body. In other words, the dust collection container 510, the suction unit 100, and the driving wheel 540 may be arranged in an approximate straight line.

A detailed description of the suction unit 100 will be described later.

Figure 4:
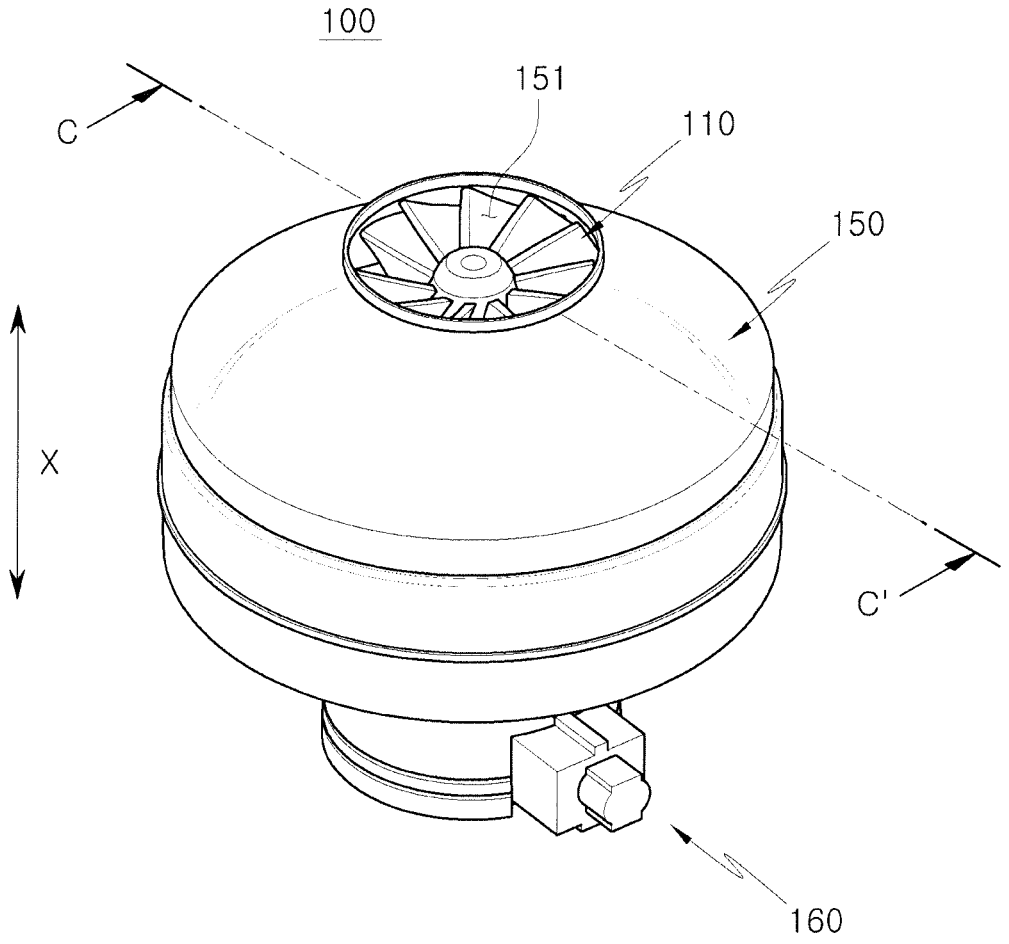
FIG. 4 is a perspective view showing a suction unit of the cleaner according to one embodiment of the present disclosure.
Figure 5:
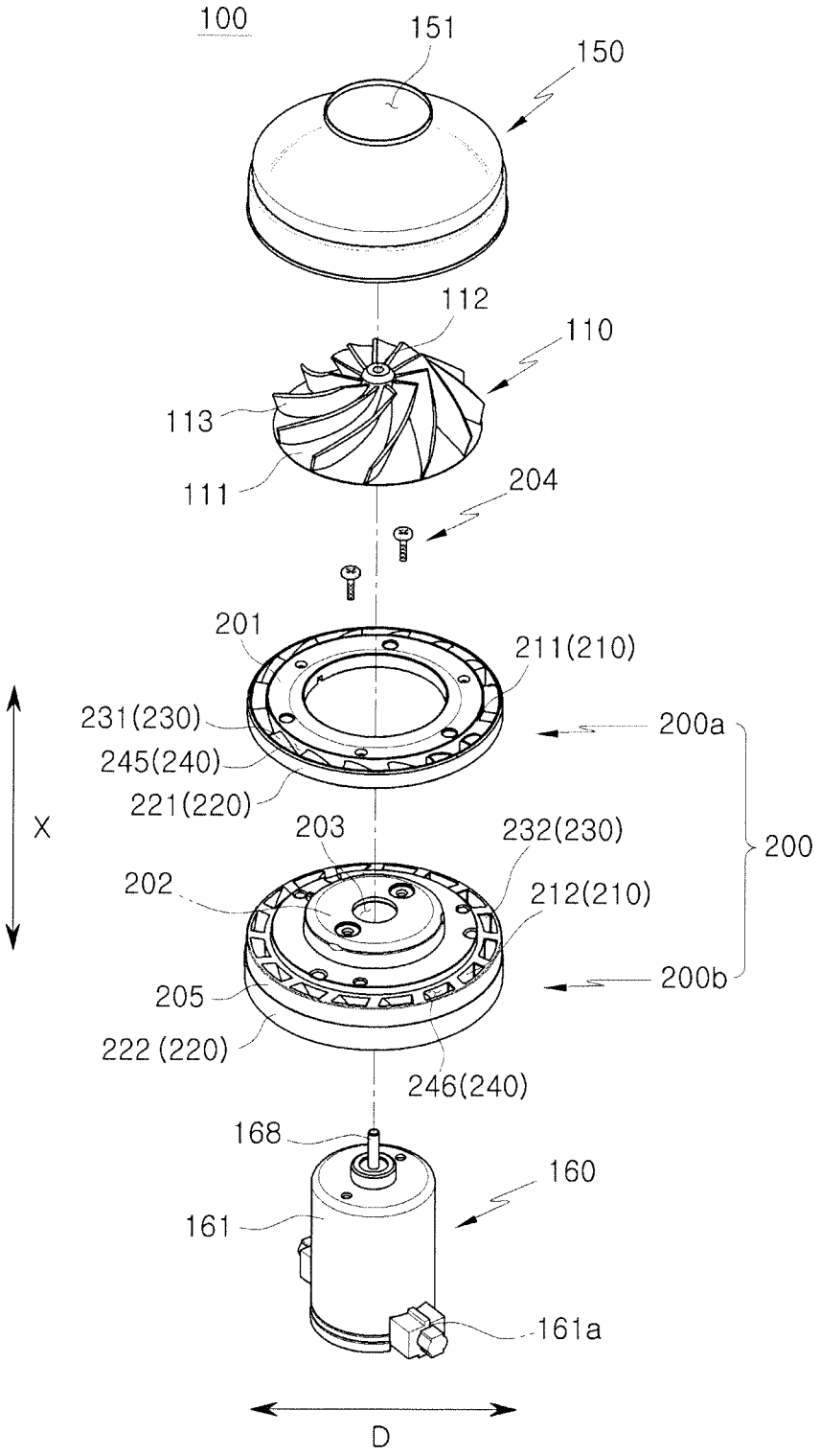
FIG. 5 is an exploded-perspective view showing the suction unit of the cleaner according to one embodiment of the present disclosure.
Figure 6:
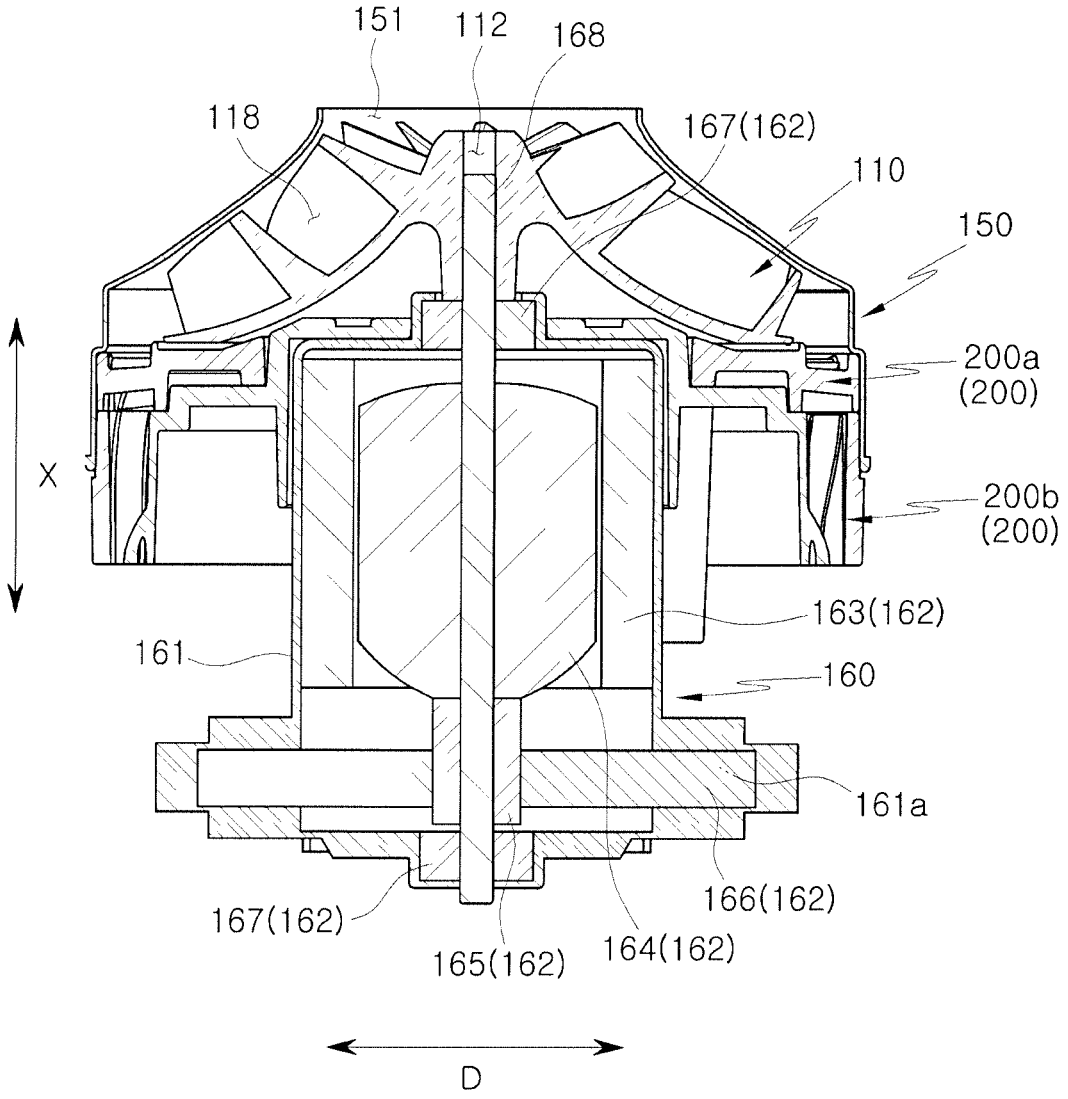
FIG. 6 is a cross-sectional view taken along line C-C' of the suction unit of FIG. 4.

FIG. 4 is a perspective view showing a suction unit of the cleaner according to one embodiment of the present disclosure, FIG. 5 is an exploded-perspective view showing the suction unit of the cleaner according to one embodiment of the present disclosure, and FIG. 6 is a cross-sectional view taken along line C-C' of the suction unit of FIG. 4.

As shown in FIGS. 4 to 6, the cleaner 1 may include the suction unit 100 generating a suction power to suction external air to the inside of the body 10 (refer to FIG. 1). The suction unit 100 may be provided inside the body 10 to generate the suction power.

The suction unit 100 may include an impeller 110. The impeller 110 may be arranged to suction air by rotating about a shaft 168. The impeller 110 may be configured with a centrifugal fan that sucks air in an axial direction X and then discharges the air in a radial direction D.

Details of the impeller 110 will be described later.

The suction unit 100 may further include a diffuser 200.

The diffuser 200 is configured to convert the kinetic energy of the air, which is suctioned into the inside of the suction unit 100 by the impeller 110, to pressure energy. In other respects, the diffuser 200 serves to reduce the flow rate of air flowing by the impeller 110. The diffuser 200 may be arranged to guide the air discharged from the impeller 110.

The diffuser 200 may include casings 210 and 220. The casings 210 and 220 may include an inner casing 210 and an outer casing 220.

The outer casing 220 may be spaced apart from the inner casing 210.

The outer casing 220 may be arranged along an outer circumference of the inner casing 210 to be spaced apart from the inner casing 210.

The inner casing 210 and the outer casing 220 may be integrally formed with each other.

The diffuser 200 may further include a vane 230.

The vane 230 may be disposed between the inner casing 210 and the outer casing 220 to guide the air discharged from the impeller 110.

The vane 230 may be disposed between the inner casing 210 and the outer casing 220 to form a flow path 240 in which the air discharged from the impeller 110 flows.

The vane 230 may connect the inner casing 210 to the outer casing 220.

The vane 230 may be integrally formed with at least one of the inner casing 210 and the outer casing 220.

The vane 230 may be integrally formed with at least one of the inner casing 210 and the outer casing 220 to connect the inner casing 210 to the outer casing 220.

The vanes 230 may include a plurality of vanes disposed to be spaced apart from each other.

The diffuser 200 may further include the flow path 240.

The flow path 240 may be formed between the plurality of vanes.

The flow path 240 may include an inlet 241 formed in an upstream side in a direction N (refer to FIG. 9) in which the air discharged from the impeller 110 flows, and an outlet 242 formed in a downstream side in the direction N in which the air discharged from the impeller 110 flows.

In another aspect, the diffuser 200 will be described as follows.

The diffuser 200 may include a first diffuser 200*a* and a second diffuser 200*b*.

The first diffuser 200*a* may be disposed above the second diffuser 200*b* in the axial direction X. Particularly, the first diffuser 200*a* may be disposed above the second diffuser 200*b* in the axial direction X to face the impeller 110. The second diffuser 200*b* may be disposed under the first diffuser 200*a* in the axial direction X to face a driving source 162.

The first diffuser 200*a* and the second diffuser 200*b* may be coupled to each other in the axial direction X.

The first diffuser 200*a* includes a first inner casing 211 and a first outer casing 221.

The first outer casing 221 may be spaced apart from the first inner casing 211.

The first outer casing 221 may be disposed along the outer circumference of the first inner housing 211 to be spaced apart from the first inner casing 211.

The first inner casing 211 and the first outer casing 221 may be integrally formed with each other.

The first diffuser 200*a* may further include a first vane 231.

The first vane 231 may be disposed between the first inner casing 211 and the first outer casing 221 to guide the air discharged from the impeller 110.

The first vane 231 may be disposed between the first inner casing 211 and the first outer casing 221 to form the flow path 240 in which the air discharged from the impeller 110 flows. In other words, the first vane 231 may be disposed between the first inner casing 211 and the first outer casing 221 to form an upstream side of the flow path 240 in which the air discharged from the impeller 110 flows.

The first vane 231 may connect the first inner casing 211 to the first outer casing 221.

The first vane 231 may be integrally formed with at least one of the first inner casing 211 to the first outer casing 221.

The first vane 231 may include a plurality of first vanes disposed to be spaced apart from each other.

The first diffuser 200*a* may further include a first flow path 245 formed between the plurality of first vanes.

The impeller 110 may be seated on the first diffuser 200*a*. That is, the first diffuser 200*a* may further include an impeller seating portion 201. The impeller seating portion 201 may be formed on one surface of the first inner casing 211 facing the impeller 110.

The second diffuser 200*b* may include a second inner casing 212 and a second outer casing 222.

The second outer casing 222 may be spaced apart from the second inner casing 212.

The second outer casing 222 may be disposed along the outer circumference of the second inner casing 212 to be spaced apart from the second inner casing 212.

The second inner casing 212 and the second outer casing 222 may be integrally formed with each other.

The second diffuser 200*b* may further include a second vane 232.

The second vane 232 together with the first vane 231 may be disposed between the second inner casing 212 and the second outer casing 222 to guide the air discharged from the impeller 110. In other words, the second vane 232 may be disposed between the second inner casing 212 and the second outer casing 222 to guide the air discharged from the first flow path 245.

The second vane 232 may be disposed between the second inner casing 212 and the second outer casing 222 to form the flow path 240 in which the air discharged from the impeller 110 flows. In other words, the second vane 232 may be disposed between the second inner casing 212 and the second outer casing 222 to form the down steam of the flow path 240 in which the air discharged from the impeller 110 flows.

The second vane 232 may connect the second inner casing 212 to the second outer casing 222.

The second vane 232 may be integrally formed with at least one of the second inner casing 212 to the second outer casing 222.

The second vane 232 may include a plurality of second vanes disposed to be spaced from each other.

The second diffuser 200*b* may further include a second flow path 246 formed between the plurality of second vanes.

The second diffuser 200*b* may further include drive unit coupling portions 202 and 203. The drive unit coupling portions 202 and 203 may be formed on the second inner casing 212.

The drive unit coupling portions 202 and 203 may include a driving source coupling portion 202 to which the driving source 162 is coupled. A part of the driving source 162 may be coupled to the drive unit coupling portion 202. Particularly, the upper portion of the driving source 162 may be coupled to the driving source coupling portion 202. The driving source 162 coupled to the drive unit coupling portions 202 may be fixed to the drive unit coupling portion 202 by a fixing member 204. Particularly, the driving source 162 coupled to the drive unit coupling portion 202 may be fixed to the drive unit coupling portion 202 by the fixing member 204 engaged in the axial direction X. The fixing member 204 may include a screw.

The drive unit coupling portions 202 and 203 may further include a shaft coupling portion 203 to which the shaft 168 is coupled. The drive unit coupling portion 203 may be formed in the second inner casing 212 to allow the shaft 168 to pass through.

The second diffuser 200*b* may further include a cover coupling portion 205 to which a cover 150 is coupled. The cover coupling portion 205 may be formed in the second outer casing 222. Particularly, the cover coupling portion 205 may be formed on an outer circumferential surface of the second outer casing 222.

The diffuser 200 may further include the flow path 240. The flow path 240 may further include the first flow path 245 and the second flow path 246. The inlet 241 (refer to FIG. 9), to which the air discharged from the impeller 110 is introduced, may be formed in the first flow path 245. The outlet 242 (refer to FIG. 9), to which the air introduced through the inlet 241 is discharged, may be formed in the second flow path 246.

The suction unit 100 may further include the cover 150. The cover 150 may be provided so as to correspond to the impeller 110 or the diffuser 200 and thus the cover 150 may guide the air introduced into the inside of the suction unit 100. The cover 150 may include an air inlet 151. The cover 150 may guide air, which is introduced through the air inlet 151, to the inside of the suction unit 100. The cover 150 may have a shape corresponding to the impeller 110. In other words, the cover 150 may have a shape corresponding to a tip 117 of a blade 113. The cover 150 may form an impeller flow path 118 (refer to FIG. 7) by being coupled to the plurality of blades of the impeller 110.

The cover 150 may be coupled to the diffuser 200 to accommodate a part of the impeller 110 and the diffuser 200 therein. Particularly, the cover 150 may be coupled to the second diffuser 200*b* to accommodate the impeller 110 and the first diffuser 200*a* therein. At this time, the cover 150 may be coupled to the cover coupling portion 205 formed on the second diffuser 200*b*.

The suction unit 100 may further include the drive unit 160 generating a suction power or a rotational force.

The drive unit 160 may include a housing 161 forming an appearance. The housing 161 may include a brush accommodating portion 161*a* in which a brush 166 is accommodated. The brush accommodating portion 161*a* may have a shape corresponding to the shape and the size of the brush 166. The brush accommodating portion 161*a* may have a shape protruding to the outside of the housing 161.

The drive unit 160 may further include the driving source 162 accommodated in the housing 161. The driving source 162 may be connected to the shaft 168 to supply the driving force to allow the impeller 110 to rotate. The driving source 162 may include a magnet 163. The magnet 163 serves to create a magnetic field. The driving source 162 may further include a rotor 164. The rotor 164 interacts with the magnet 163 to generate a rotational force. The driving source 162 may further include a commutator 165. The commutator 165 may regulate the direction of the current to allow the rotational force to be generated in always same direction. The driving source 162 may further include the brush 166. The brush 166 serves to supply electricity by being in contact with the rotating commutator 165. The driving source 162 may include the brush 166 that is elongated in a direction in which the brush accommodating portion 161*a* is protruded from the housing 161. That is, the driving source 162 may include a brush that is bigger or longer than the conventional brush. The brush 166 may be consumed by friction with the commutator 165. The consumption of the brush 166 may lead to shortening of the life of the driving source 162, and thus the lifetime extension of the driving source 162 may be expected by increasing the size or length of the brush 166. The driving source 162 may further include a bearing 167. The bearing 167 may be arranged to support the shaft 168. For example, the bearing 167 may include a plurality of bearings supporting the shaft 168 from the upper end portion and the lower end portion of the housing 161.

The driving source 162 may include a permanent magnet direct current (PMDC) motor. When the PMDC motor is used as the driving source 162, it is possible to design the suction unit 100 that is more compact than using a universal motor and cheaper than using a brushless direct current (DLDC) motor. In the conventional manner, the life of the PMDC motor may be reduced due to the wear of the brush 166 caused by the friction between the commutator 165 and the brush 166. However, when comparing a semi-open impeller such as the impeller 110 according to one embodiment with an enclosed impeller under the same diameter condition, the semi-open impeller has the less number of rotations to acquire the same suction power and thus it is possible to reduce the wear of the brush 166. Therefore, it is possible to extend the life of PMDC motor. The noise reduction effect may be acquired by a small number of rotations of the PMDC motor.

The drive unit 160 may further include the shaft 168. The shaft 168 may be accommodated inside the housing 161 to pass through the diffuser 200 and then coupled to a shaft coupling hole 112 of the impeller 110. Inside the housing 161, the shaft 168 may be supported by the bearing 167.

Figure 7:
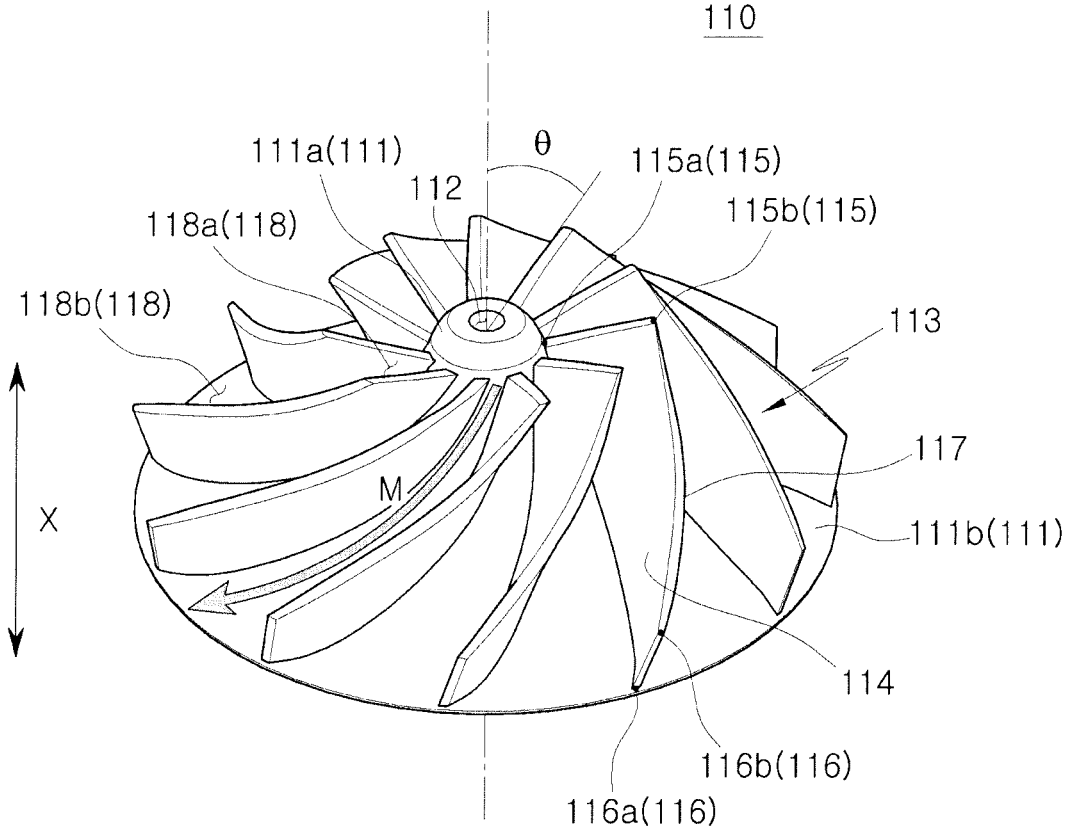
FIG. 7 is an enlarged view of an impeller in the suction unit of the cleaner according to one embodiment of the present disclosure.

FIG. 7 is an enlarged view of an impeller in the suction unit of the cleaner according to one embodiment of the present disclosure.

As shown in FIG. 7, the impeller 110 may include a hub 111. The hub 111 may include a central portion 111*a* and an edge portion 111*b* disposed in a lower position than the central portion 111*a* in the axial direction X. As for a height of the hub 111 with respect to the axial direction X, a height of the central portion 111*a* is higher than a height of the edge portion 111*b*. Particularly, the height of the hub 111 may gradually decrease from the central portion 111*a* toward the edge portion 111*b*. This is to reduce the flow loss by preventing air, which is introduced via the air inlet 151, from being suddenly curved from the vertical direction to the horizontal direction. In other words, this is to reduce the flow loss by preventing air, which is introduced via the air inlet 151, from being suddenly curved from the axial direction X to the direction perpendicular to the axial direction X.

The hub 111 may further include the shaft coupling hole 112. The shaft coupling hole 112 may be formed in the central portion 111*a* of the hub 111 to allow the shaft 168 to be coupled thereto.

The impeller 110 may further include the blade 113. The blade 113 may be disposed on the hub 111.

The blade 113 may include a blade body 114.

The blade 113 may further include a leading edge 115. The leading edge 115 may be formed at one end of the blade body 114. Particularly, the leading edge 115 may be formed at one end of the blade body 114, wherein the one end thereof is placed in the upstream side in a direction M in which air introduced to the suction unit 100 flows. In short, the leading edge 115 may be disposed in the upstream side in the direction M in which air introduced to the suction unit 100 flows.

The leading edge 115 may include a first end 115*a* and a second end 115*b*.

The first end 115*a* may be directed to the inner direction of the hub 111. In other words, the first end 115*a* may be coupled to the hub 111.

The second end 115*b* may be directed to the outside of the hub 111. In other words, the second end 115*b* may be disposed on the opposite side of the first end 115*a*.

The first end 115*a* of the leading edge 115 may be disposed at a lower position than the second end 115*b* of the leading edge 115 in the axial direction X.

The blade 113 may further include a trailing edge 116. The trailing edge 116 may be formed at the other end of the blade body 114. Particularly, the trailing edge 116 may be formed at the other end of the blade body 114, wherein the other end thereof is placed in the downstream side in the direction M in which air introduced to the suction unit 100 flows. In short, the trailing edge 116 may be disposed in the downstream side in the direction M in which air introduced to the suction unit 100 flows.

Figure 9:
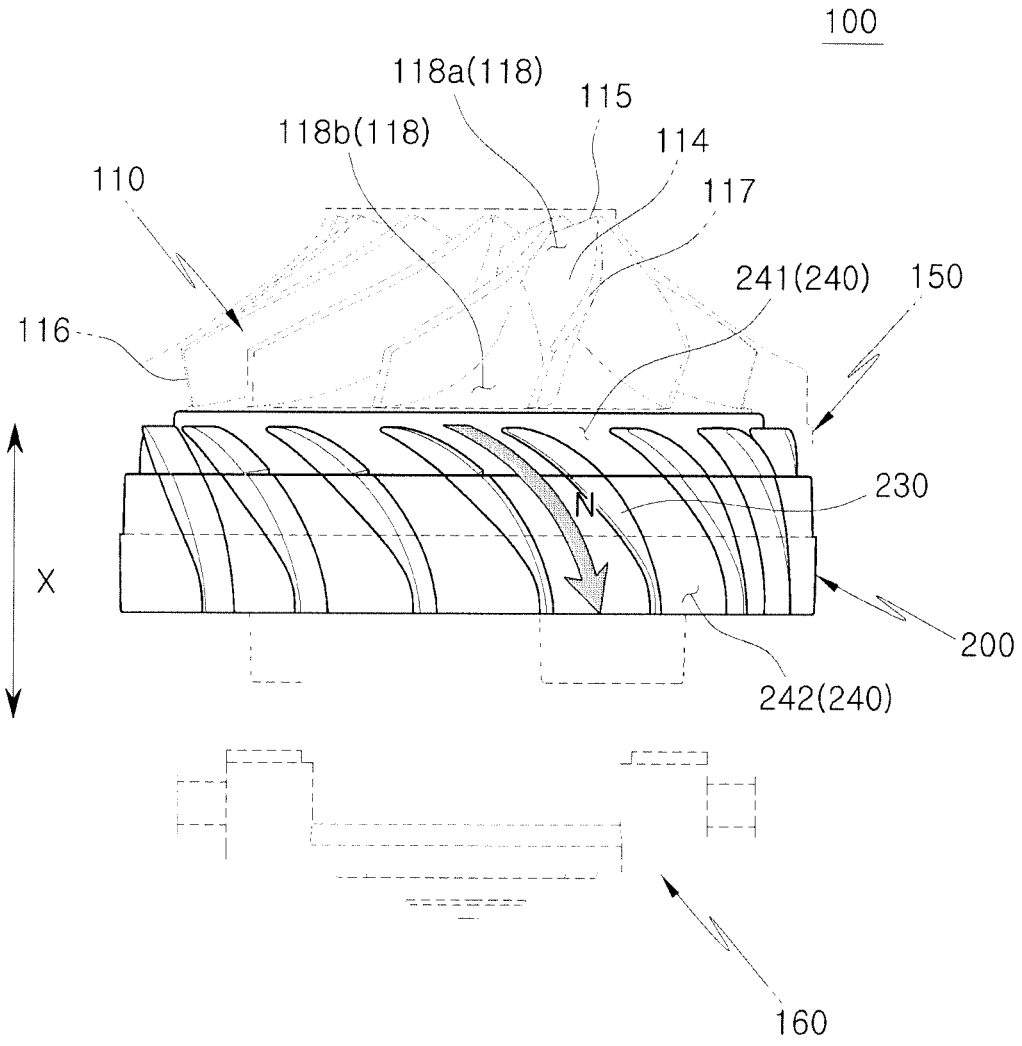
FIG. 9 is a front view of the suction unit of the cleaner according to one embodiment of the present disclosure.

As shown in FIG. 9 described later, the trailing edge 116 may be disposed at a higher position in the axial direction than one end of the vane 230 disposed in the upstream side of the flow path 240.

The trailing edge 116 may include a first end 116*a* and a second end 116*b*.

The first end 116*a* may be directed to the inner direction of the hub 111. In other words, the first end 116*a* may be coupled to the hub 111.

The second end 116*b* may be directed to the outside of the hub 111. In other words, the second end 116*b* may be disposed on the opposite side of the first end 116*a*.

The blade 113 may further include the tip 117. The tip 117 may be formed on one side of the blade body 114 to connect the leading edge 115 to the trailing edge 116. Particularly, the tip 117 may be formed on one side of the blade body 114 to connect the second end 115*b* of the leading edge 115, which is not coupled to the hub 111, to the second end 116*b* of the trailing edge 116, which is not coupled to the hub 111. In other words, the tip 117 may be formed on one side of the blade body 114 to connect the second end 115*b* of the leading edge 115, which is directed to the outside of the hub 111, to the second end 116*b* of the trailing edge 116, which is directed to the outside the hub 111.

The blade 113 may be disposed on the hub 111 to be inclined. Particularly, the blade body 114 may be disposed on the hub 111 to be inclined with respect to the axial direction X.

The blade 113 may be disposed on the hub 111 in a twisted state.

The blade 113 may include a plurality of blades disposed on the hub 111 to be spaced apart from each other. The plurality of blades may be radially disposed on the hub 111 with respect to the shaft 168.

The impeller 110 may further include the impeller flow path 118. The impeller flow path 118 may be formed between the plurality of blades. A width of the impeller flow path 118 may be minimized in an upstream side of the impeller flow path 118 corresponding to the leading edge 115, and may be maximized in a downstream side of the impeller flow path 118 corresponding to the trailing edge 116. As the impeller flow path 118 becomes narrower, the air velocity of the flowing air may increase. As the impeller flow path 118 becomes wider, the amount of flowing air may increase. Thus, in the upstream side of the impeller flow path 118, it is possible quickly move air introduced via the air inlet 151, and in the downstream side of the impeller flow path 118, it is possible move the large amount of the air to the diffuser 200.

The impeller flow path 118 may include an impeller inlet 118*a* and an impeller outlet 118*b*. The impeller inlet 118*a* may be defined by the hub 111, the leading edge 115, and the cover 150. The impeller outlet 118*b* may be defined by the hub 111, the trailing edge 116, and the cover 150. The impeller inlet 118*a* may be formed in the upstream side of the impeller flow path 118 and the impeller outlet 118*b* may be formed in the downstream side of the impeller flow path 118.

The shape and arrangement of the impeller 110 may be variously modified as long as it is to allow air to flow.

Since the air, which is introduced into the inside of the suction unit 100 via the air inlet 151, flows in a direction inclined with respect to the axial direction X at the impeller inlet 118*a*, the leading edge 115 of the blade 113 may also be inclined with respect to the axial direction X. Particularly, the leading edge 115 of the blade 113 may form an inclination of 60 degrees or more and 80 degrees or less with respect to the axial direction X. It is appropriate that the leading edge 115 of the blade 113 forms the inclination of 60 degrees or more and 80 degrees or less with respect to the axial direction X. The influence of the angle of the leading edge 115 of the blade 113 on the suction efficiency of the cleaner 1 will be described with reference to FIG. 8.

Figure 8:
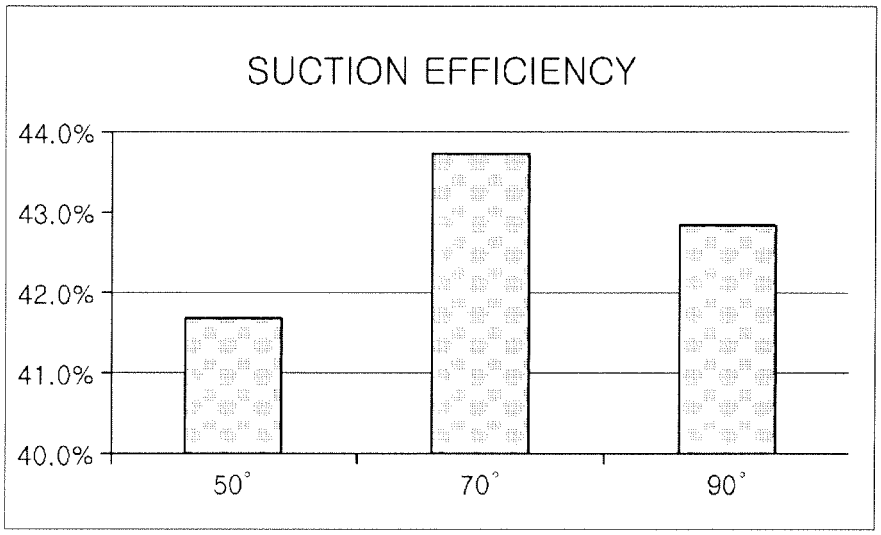
FIG. 8 is a graph showing a suction efficiency according to a blade angle in the suction unit of the cleaner according to one embodiment of the present disclosure.

FIG. 8 is a graph showing a suction efficiency according to a blade angle in the suction unit of the cleaner according to one embodiment of the present disclosure.

As illustrated in the graph of FIG. 8, when the leading edge 115 of the blade 113 is formed at 50 degrees with respect to the axial direction X, the suction efficiency of the cleaner 1 is an approximate 42%. When the leading edge 115 of the blade 113 is formed at 70 degrees with respect to the axial direction X, the suction efficiency of the cleaner 1 is an approximate 44%. When the leading edge 115 of the blade 113 is formed at 90 degrees with respect to the axial direction X, the suction efficiency of the cleaner 1 is an approximate 43%. That is, when the leading edge 115 of the blade 113 is formed at 70 degrees with respect to the axial direction X, it can be confirmed that the suction efficiency of the cleaner 1 is most increased.

FIG. 9 is a front view of the suction unit of the cleaner according to one embodiment of the present disclosure.

As shown in FIG. 9, the vane 230 may have an airfoil shaped cross section in the axial direction X. Particularly, one end of the vane 230 corresponding to the inlet 241 corresponds to the leading edge and the other end of the vane 230 corresponding to the outlet 242 corresponds to the trailing edge. As mentioned above, when the vane 230 has the airfoil shaped cross section, it is possible to increase the suction efficiency and to reduce the noise of the cleaner 1 by minimizing turbulence and vortex flow of air flowing along the vane 230.

Figure 10:
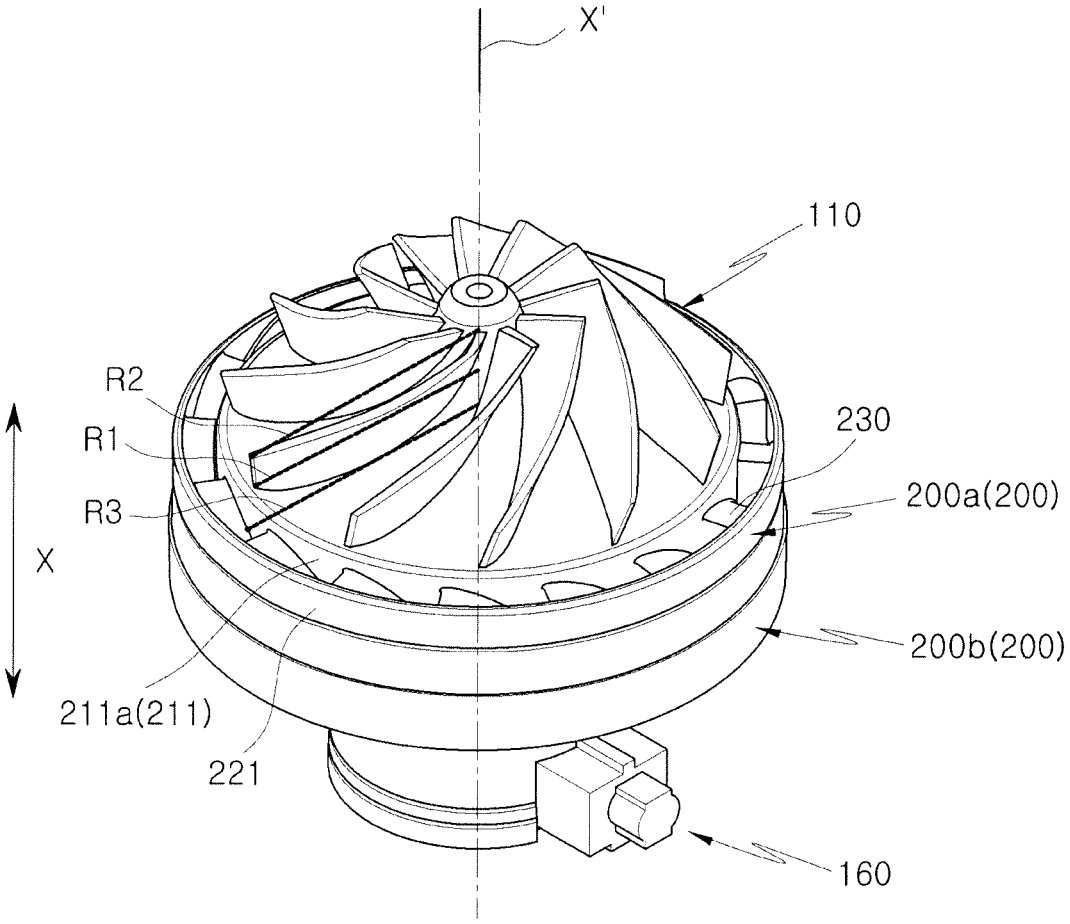
FIG. 10 is a perspective view showing a state in which a cover is removed in the suction unit of the cleaner according to one embodiment of the present disclosure.

FIG. 10 is a perspective view showing a state in which a cover is removed in the suction unit of the cleaner according to one embodiment of the present disclosure. In FIG. 10, X' represents an imaginary line extending from the shaft 168.

As shown in FIG. 10, the trailing edge 116 of the blade 113 may include the first end 116*a* and the second end 116*b*.

A distance R1 between the shaft 168 and the first end 116*a* of the trailing edge 116 may be less than a distance R2 between the shaft 168 and the second end 116*b* of the trailing edge 116.

The inner casing 210 of the diffuser 200 may include an outer circumferential surface 211*a* facing the outer casing 220 of the diffuser 200.

A distance R3 between the shaft 168 and the outer circumferential surface 211*a* of the inner casing 210 of the diffuser 200 may be greater than the distance R2 between the shaft 168 and the second end 116*b* of the trailing edge 116. Particularly, a distance R3 between the shaft 168 and the outer circumferential surface 211*a* of the first inner casing 211 of the first diffuser 200*a* may be greater than the distance R2 between the shaft 168 and the second end 116*b* of the trailing edge 116.

It is appropriate that a relationship among the distance R1 between the shaft 168 and the first end 116*a* of the trailing edge 116, the distance R2 between the shaft 168 and the second end 116*b* of the trailing edge 116, and the distance R3 between the shaft 168 and the outer circumferential surface 211*a* of the inner casing 210 of the diffuser 200 may satisfy a relation of "R1<R2<R3". When the suction unit 100 is designed to satisfy the relation of "R1<R2<R3", the improvement in the suction efficiency of the cleaner 1 may be expected. A detailed description of the relationship among R1, R2, and R3 will be described later with reference to FIG. 11.

Figure 11A:
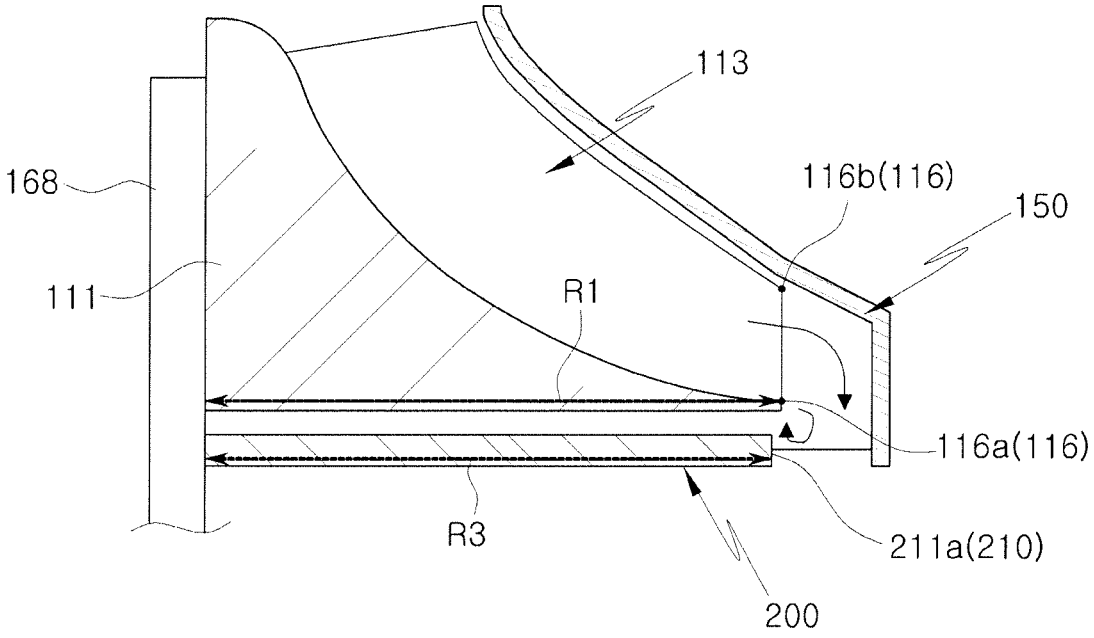
FIGS. 11A to 11C are views showing a relationship among R1, R2 and R3 in the suction unit of the cleaner according to one embodiment of the present disclosure.
Figure 11B:
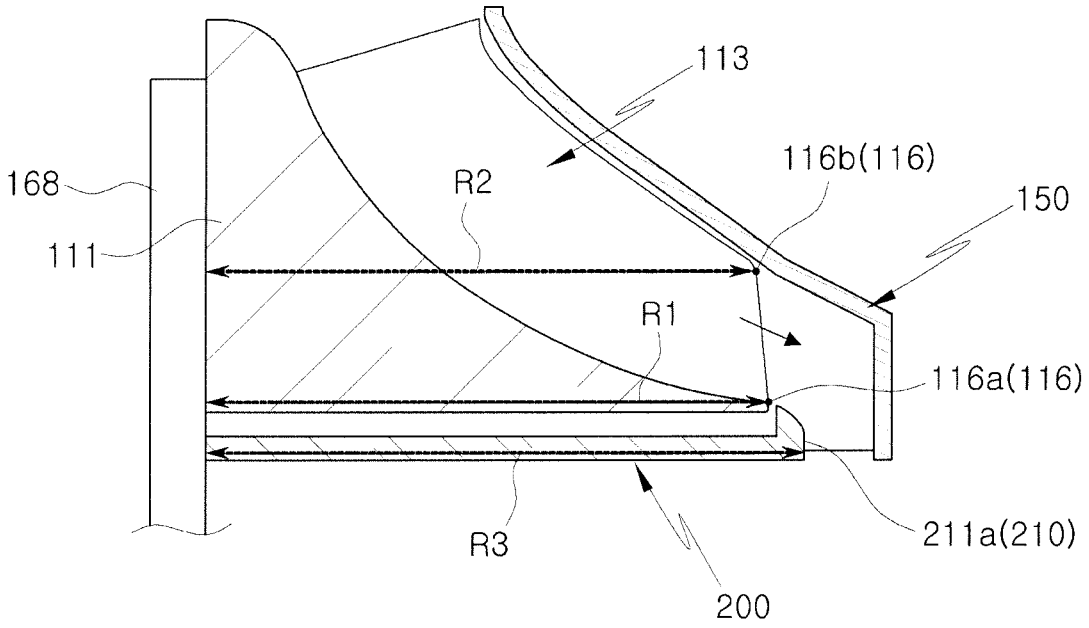
Figure 11C:
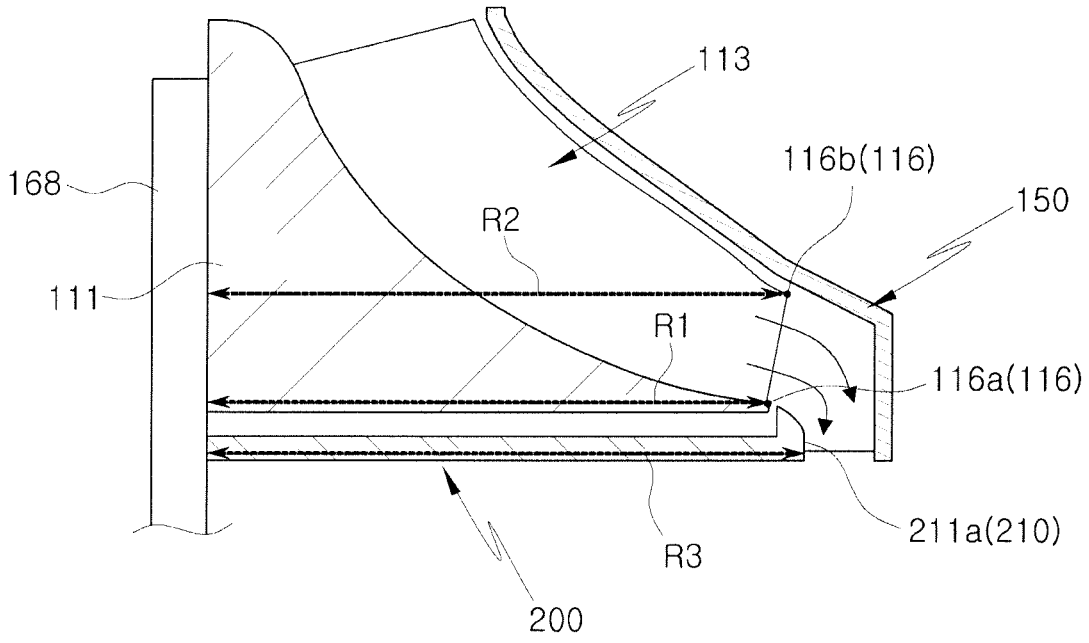

FIGS. 11A to 11C are views showing a relationship among R1, R2 and R3 in the suction unit of the cleaner according to one embodiment of the present disclosure. FIG. 11 is a schematic view showing the relationship among R1, R2, and R3.

FIG. 11A illustrates that the distance R1 between the shaft 168 and the first end 116*a* of the trailing edge 116 is greater than the distance R3 between the shaft 168 and the outer circumferential surface 211*a* of the inner casing 210 of the diffuser 200. In this case, as illustrated in FIG. 11A, a vortex may occur in a space between the impeller 110 and the diffuser 200. Such a vortex may interfere with the flow of air flowing along the impeller flow path 118 and the flow path 240. Therefore, the suction efficiency of the cleaner 1 may be reduced.

FIG. 11B illustrates that the relationship among the distance R1 between the shaft 168 and the first end 116*a* of the trailing edge 116, the distance R2 between the shaft 168 and the second end 116*b* of the trailing edge 116, and the distance R3 between the shaft 168 and the outer circumferential surface 211*a* of the inner casing 210 of the diffuser 200 satisfies a relation of "R2<R1<R3". In this case, as shown in FIG. 11B, the flow of air flowing along the impeller flow path 118 and the flow path 240 may be weak and thus the suction efficiency of the cleaner 1 may be reduced.

FIG. 11C illustrates that the relationship among the distance R1 between the shaft 168 and the first end 116*a* of the trailing edge 116, the distance R2 between the shaft 168 and the second end 116*b* of the trailing edge 116, and the distance R3 between the shaft 168 and the outer circumferential surface 211*a* of the inner casing 210 of the diffuser 200 satisfies a relation of "R1<R2<R3". In this case, as shown in FIG. 11C, the air introduced into the suction unit 100 may smoothly flow along the impeller flow path 118 and the flow path 240, and thus the suction efficiency of the cleaner 1 may be increased.

Figure 12:
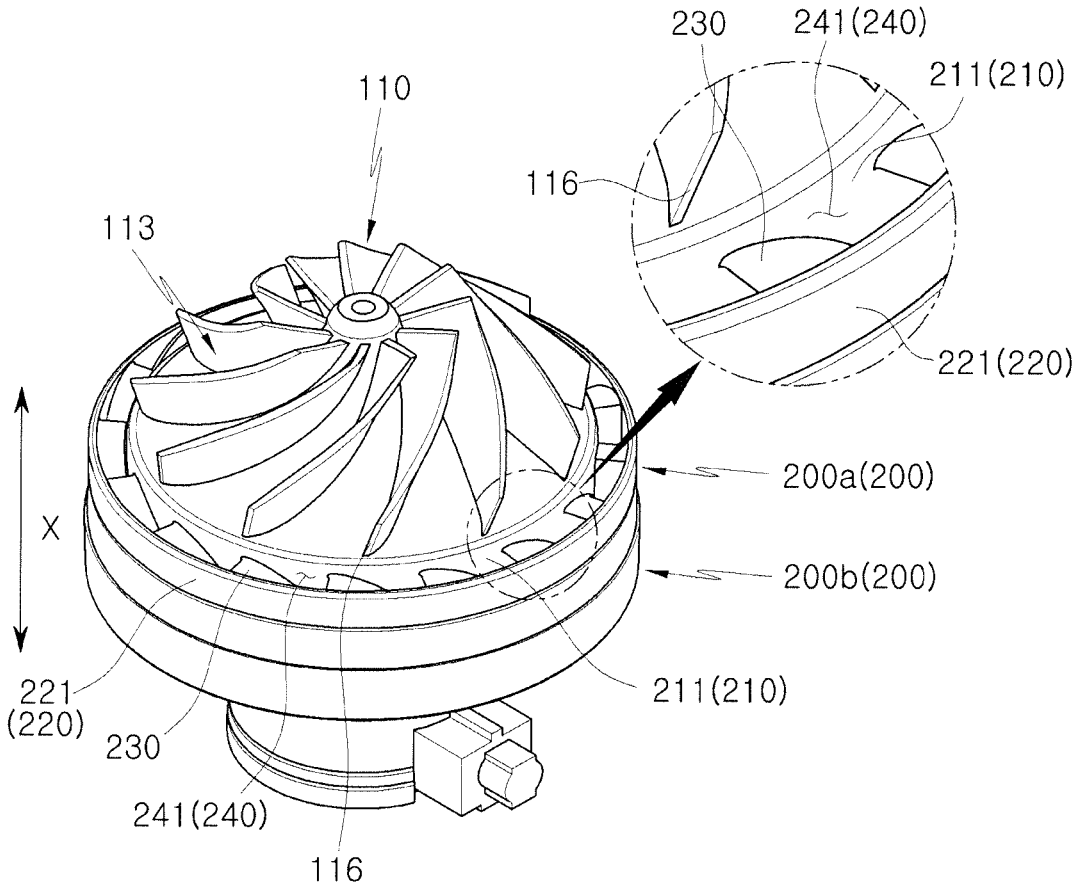
FIG. 12 is a perspective view showing a state in which the cover is removed to illustrate an arrangement relationship between the blade and a vane in the suction unit of the cleaner according to one embodiment of the present disclosure.

FIG. 12 is a perspective view showing a state in which the cover is removed to illustrate an arrangement relationship between the blade and a vane in the suction unit of the cleaner according to one embodiment of the present disclosure.

As illustrated in FIG. 12, one end of the vane 230 disposed in the upstream side of the flow path 240 may be disposed at a lower position in the axial direction X than at least one of the upper end of the inner casing 210 and the upper end of the outer casing 220 disposed in the upstream side of the flow path 240. Particularly, one end of the vane 230 forming the inlet 241 of the flow path 240 may be disposed at a lower position in the axial direction X than at least one of the upper end of the first inner casing 211 and the upper end of the first outer casing 221 disposed in the upstream side of the flow path 240. It is appropriate that one end of the vane 230 forming the inlet 241 of the flow path 240 may be disposed at a lower position in the axial direction X than at least one of the upper end of the first inner casing 211 and the upper end of the first outer casing 221 disposed in the upstream side of the flow path 240.

When a distance between the trailing edge 116 of the blade 113 and the one end of the vane 230 forming the inlet 241 of the flow path 240 is small, the noise may occur by the interaction between the trailing edge 116 of the blade 113 and the one end of the vane 230 forming the inlet 241 of the flow path 240. Therefore, when the one end of the vane 230 disposed in the upstream side of the flow path 240 is designed to be disposed at a lower position in the axial direction X than at least one of the upper end of the inner casing 210 and the upper end of the outer casing 220 disposed in the upstream side of the flow path 240, it is possible to reduce the noise.

While the present disclosure has been particularly described with reference to exemplary embodiments, it should be understood by those of skilled in the art that various changes in form and details may be made without departing from the spirit and scope of the present disclosure.

The invention claimed is:

1. A cleaner comprising:

a suction unit provided inside a body, wherein the suction unit comprises an impeller configured to suction air by rotating about a shaft; and a diffuser configured to guide air discharged from the impeller, wherein the impeller comprises a hub; and a blade disposed on the hub, and provided with a leading edge disposed in an upstream side in a direction in which air introduced into the suction unit flows and a trailing edge disposed in a downstream side in the direction in which the air introduced into the suction unit flows, wherein the leading edge of the blade forms an inclination of 60 degrees or more and 80 degrees or less with respect to an axial direction, and wherein the diffuser comprises a first diffuser on which the impeller is seated, and a second diffuser coupled to the first diffuser in the axial direction-.

2. The cleaner according to claim 1, wherein the diffuser further comprises an inner casing, an outer casing arranged along an outer circumference of the inner casing to be spaced apart from the inner casing, and a vane disposed between the inner casing and the outer casing to form a flow path in which air discharged from the impeller flows.

3. The cleaner according to claim 2, wherein the vane has an airfoil shaped cross-section in the axial direction.

4. The cleaner according to claim 2, wherein one end of the vane disposed in an upstream side of the flow path is disposed at a lower position in the axial direction than at least one of an upper end of the inner casing and an upper end of the outer casing disposed in the upstream side of the flow path.

5. The cleaner according to claim 2, wherein the trailing edge comprises a first end coupled to the hub, and a second end disposed on the opposite side of the first end, and wherein a distance (R1) between the shaft and the first end is less than a distance (R2) between the shaft and the second end.

6. The cleaner according to claim 5, wherein the inner casing comprises an outer circumferential surface facing the outer casing, and wherein a distance (R3) between the shaft and the outer circumferential surface of the inner casing is greater than the distance R2 between the shaft and the second end.

7. The cleaner according to claim 1, wherein the suction unit further comprises a driving source connected to the shaft to provide a driving force to allow the impeller to rotate, and wherein the driving source comprises a permanent magnet direct current (PMDC) motor.

8. The cleaner according to claim 1, wherein the suction unit further comprises a cover provided with an air inlet, and coupled to the second diffuser to accommodate the impeller and the first diffuser therein.

9. A cleaner comprising:

a suction unit provided inside a body, wherein the suction unit comprises an impeller configured to suction air by rotating about a shaft; and a diffuser configured to guide air discharged from the impeller, wherein the impeller comprises a hub; and a blade disposed on the hub, and provided with a trailing edge disposed in a downstream side in a direction in which the air introduced into the suction unit flows, the trailing edge having a first end coupled to the hub and a second end disposed on the opposite side of the first end, wherein a distance (R1) between the shaft and the first end is less than a distance (R2) between the shaft and the second end, and wherein the diffuser comprises a first diffuser on which the impeller is seated, and a second diffuser coupled to the first diffuser in the axial direction.

10. The cleaner according to claim 9, wherein the diffuser further comprises an inner casing, an outer casing arranged along an outer circumference of the inner casing to be spaced apart from the inner casing, and a vane disposed between the inner casing and the outer casing to form a flow path in which air discharged from the impeller flows.

11. The cleaner according to claim 10, wherein the inner casing comprises an outer circumferential surface facing the outer casing, and wherein a distance (R3) between the shaft and the outer circumferential surface of the inner casing is greater than the distance R2 between the shaft and the second end.

12. The cleaner according to claim 10, wherein the vane has an airfoil shaped cross-section in an axial direction.

13. The cleaner according to claim 9, wherein the leading edge of the blade forms an inclination of 60 degrees or more and 80 degrees or less with respect to an axial direction.

14. The cleaner according to claim 9, wherein the suction unit further comprises a driving source connected to the shaft to provide a driving force to allow the impeller to rotate, and wherein the driving source comprises a permanent magnet direct current (PMDC) motor.

* * * * *